United States Patent [19]

Neubrand

[11] 3,960,209

[45] June 1, 1976

[54] REGENERATIVE HEAT EXCHANGER OF A GAS TURBINE

[75] Inventor: Franz Neubrand, Unterwilzingen, Germany

[73] Assignee: Daimler-Benz Aktiengesellschaft, Germany

[22] Filed: Apr. 18, 1975

[21] Appl. No.: 569,294

[30] Foreign Application Priority Data

Apr. 22, 1974 Germany ..... 2419376

[52] U.S. Cl. ..... 165/8; 267/162; 74/443; 74/446

[51] Int. Cl.[2] ..... F28D 19/00

[58] Field of Search ..... 165/8, 10; 267/162, 267/161; 74/443, 446; 64/27 R, 27 L; 152/71, 72

[56] References Cited

UNITED STATES PATENTS

| | | | |
|---|---|---|---|
| 3,496,993 | 2/1970 | Azelborn | 165/8 |
| 3,623,544 | 11/1971 | McLean | 165/8 |
| 3,789,917 | 2/1974 | Jarry | 165/10 X |
| 3,794,109 | 2/1974 | Hughes | 165/8 |

*Primary Examiner*—Albert W. Davis, Jr.
*Attorney, Agent, or Firm*—Craig & Antonelli

[57] ABSTRACT

A regenerative heat-exchanger of a gas turbine whose ceramic heat-exchanger disk is coaxially surrounded by a metallic toothed rim under formation of an annular space in which are arranged springs; the springs are constituted by spring packets of cup springs which are guided on both sides in concave recesses in two webs arranged in the circumferential direction on entrainment plates which surround the lateral surfaces of the toothed rim and are non-rotatably connected therewith.

7 Claims, 4 Drawing Figures

REGENERATIVE HEAT EXCHANGER OF A GAS TURBINE

The present invention relates to a regenerative heat-exchanger of a gas turbine whose ceramic heat-exchanger disk is coaxially surrounded by metallic toothed rim under formation of an annular space, in which are arranged compression springs which are supported under prestress, on the one hand, at entrainment plates abutting at the circumference of the heat-exchanger disk and on the other, against the inner side of the toothed rim. The compression springs thereby serve to compensate for the larger thermal expansion of the metallic toothed rim with respect to the ceramic heat-exchanger disk which has a very small coefficient of thermal expansion.

In one prior art construction of this type (British Patent 1,324,731), the compression springs consist of springs of truncated, conical shape which in addition to a relatively large space requirement, entail the disadvantage for a mounting support that, as is normally the case in connection with compression springs, the abutment force decreases with the expansion thereof. This leads during the operation to an undesired slippage or even to a displacement of the heat-exchanger disk. Stronger springs, by means of which one is able to counter-act these disadvantages, require additional space which, however, in heat-exchangers for gas turbines is extraordinarily limited, especially when the same are installed into vehicles.

The present invention is concerned with the task to eliminate these disadvantages and to provide an arrangement of the heat-exchanger disk within the toothed rim which, with an extraordinarily slight radial space requirement, produces a mounting support of the heat-exchanger disk, reliable at all operating temperatures, and a slippage-free torque transmission. This takes place according to the present invention by spring packets or packages formed by cup springs, which are guided on both sides thereof within concave recesses in two webs arranged in the circumferential direction on the entrainment plate, which webs surround the lateral surfaces of the toothed rim and are non-rotatably connected therewith for rotation in unison therewith. It is possible by the special characteristics of cup springs to construct the same in such a manner that expansions or compressions of the spring packet cause no significant changes of the spring forces with changes in the size of the annular space as a result of temperature changes so that the entrainment plates abut always under the same or possibly also under a somewhat increasing abutment pressure at the heat-exchanger disk. The small height of the cup springs is thereby completely utilized since the torque transmission from the toothed rim to the entrainment plates is assumed by the lateral surfaces of the toothed rim without requiring any additional radial space and by webs surrounding the same and guiding the spring packets.

A structurally particularly simple torque transmission which enables a sufficient radial play, is achieved according to the present invention in that manually oppositely disposed radial bars are arranged at the inner sides of the two webs of an entrainment plate, which engage in radial grooves at the lateral surfaces of the toothed rim.

According to a further advantageous construction of the present invention, respectively two spring packets are supported on a single entrainment plate whereby common webs, bars and grooves coordinated thereto are arranged in the center axial plane between the two spring packets in a particularly spacesaving manner.

According to the present invention, one bore each may be provided within the area of the two ends of each web. These bores enable in a simple manner, the application of tools or assembly devices for the installation or removal of the heat-exchanger disk into or out of the toothed rim.

Accordingly, it is an object of the present invention to provide a regenerative heat-exchanger of a gas turbine which avoids by simple means the aforementioned shortcomings and drawbacks encountered in the prior art.

Another object of the present invention resides in a regenerative heat-exchanger of a gas turbine in which the mounting support for the heat-exchanger disk within the toothed rim is realized without relatively large space requirements.

A further object of the present invention resides in a mounting support of a heat-exchanger disk within the toothed rim of a regenerative heat-exchanger of a gas turbine which is simple in construction, maintains or increases the abutment pressure with expansion of the parts and avoids during operation any undesired slippage or displacement of the heat-exchanger disk.

A still further object of the present invention resides in a regenerative heat-exchanger of a gas turbine in which a reliable mounting of the heat-exchanger disk and a slippage-free torque transmission is realized under all operating conditions with extraordinarily small radial space requirements.

Another object of the present invention resides in a regenerative heat-exchanger of the type described above which excels by a structurally particularly simple torque transmission, providing sufficient radial play.

Still a further object of the present invention resides in a regenerative heat-exchanger of gas turbines in which the heat-exchanger disk can be readily installed and removed by the use of simple tools.

These and further objects, features and advantages of the present invention will become more apparent from the following description when taken in connection with the accompanying drawing which shows, for purposes of illustration only, one embodiment in accordance with the present invention, and wherein.

Figure 2:
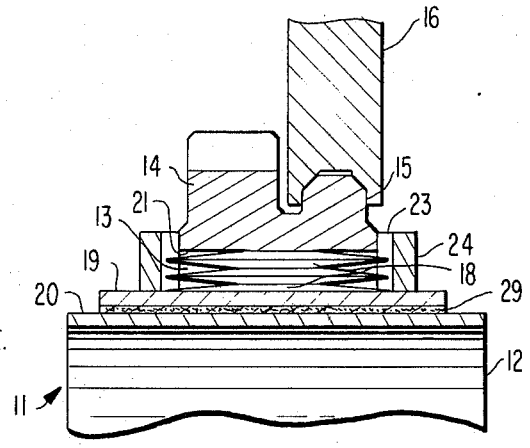
FIG. 2 is an axial cross-sectional view through the heat-exchanger disk and the toothed rim thereof taken along line II—II of FIG. 1.
Figure 3:
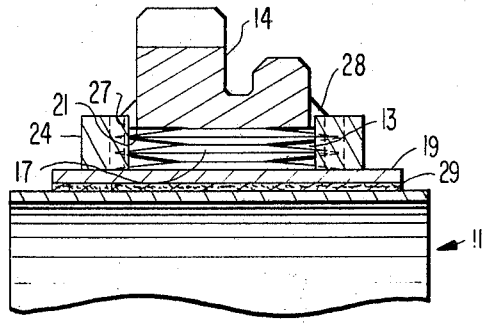
FIG. 3 is an axial cross-sectional view through the heat-exchanger disk and the toothed rim thereof taken along line III—III of FIG. 1.
Figure 4:
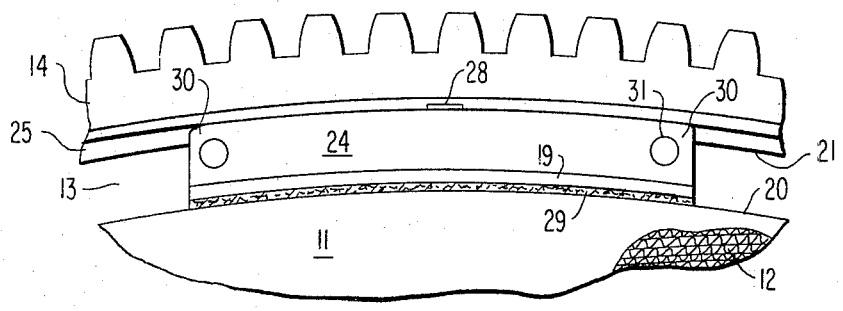
FIG. 4 is a partial side view of the heat-exchanger disk and the toothed rim in accordance with the present invention, illustrated in FIG. 1.

Referring now to the drawing wherein like reference numerals are used throughout the various views to designate like parts, the heat-exchanger disk generally designated by reference numeral 11 of a motor vehicle gas turbine, which is illustrated in the drawing, is made from a glass-ceramic material. It includes a large number of through-channels 12 (FIG. 2) which are traversed alternately by hot exhaust gases or by the combustion air to be heated up. The heat-exchanger disk 11 is coaxially surrounded by a toothed rim 14 (FIGS. 2, 3 and 4) of an alloy steel under formation of an annular space 13. The toothed rim 14 is supported on rollers 16 (FIG. 2) in the housing (not shown) of the heat-exchanger by means of a rail 15. The toothed rim 14 serves to drive the heat-exchanger disk 11 and, in its turn, is driven by a pinion (not shown) of an auxiliary drive of the gas turbine. The annular space 13 between the heat-exchanger disk 11 and the toothed rim 14 is bridged by spring packets 17 which are formed by cup springs 18. The spring packets 17 are supported under prestress, on the one hand, at entrainment plates 19 which abut at the circumference 20 of the heat-exchanger disk 11 and, on the other, against the inside 21 of the toothed rim 14.

Figure 1:
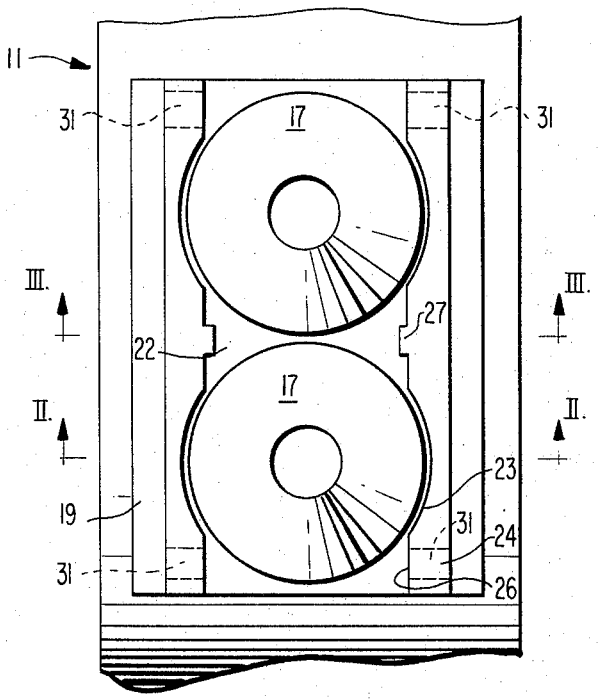
FIG. 1 is a partial plan view on an entrainment plate abutting at a heat-exchanger disk and provided with two spring packets in accordance with the present invention.

For example, 24 entrainment plates 19, curved corresponding to the disk radius, are uniformly distributed at slight mutual spacings over the circumference 20 of the heat-exchanger disk 11. Two spring packets 17 are coordinated to each entrainment plate 19 which consist each of five cup springs 18. Four cup springs 18 are thereby so assembled pairwise that they contact each other along their outer edge. The fifth cup spring 18 is supported with its outer edge at a flat surface 22 (FIG. 1) of the entrainment plate 19. The two spring packets 17 are guided on both sides in concave apertures 23 by webs 24 which are secured in the circumferential direction on the entrainment plate 19.

The two webs 24 of each entrainment plate 19 surround the lateral surfaces of the toothed rim 14. In the center axial plane between the two spring packets 17, bars 27 (FIGS. 1 and 3) are arranged at the inner sides 26 of the webs 24, which engage in corresponding radial grooves 28 (FIG. 3) provided at the lateral surfaces 25 of the toothed rim 14. With a rotating toothed rim 14, the groove 28 abuts with a lateral surface at the oppositely disposed flank of the bar 27 so that a form-locking connection is established for the transmission of torque to the entrainment plate 19. The entrainment plate 19, in its turn, transmits the torque to the heat-exchanger disk 11 under a constant or slightly increasing pressure of the spring packets 17. An adhesive layer 29 (FIGS. 2, 3 and 4) at the inside of the entrainment plate 19 which, for example, consists of an elastomer, contributes to the good abutment and torque transmission. Axial forces which possibly act on the heat-exchanger disk 11 as a result of the abutment pressure of seals, are transmitted to the toothed rim 14 by way of the entrainment plates 19 and the webs 24 thereof.

One bore 31 each (FIGS. 1 and 4) is arranged within the area of the two ends 30 (FIG. 4) of each web 24, which serve for the installation of the heat-exchanger disk 11 into the toothed rim 14 or the disassembly thereof. For the installation of the heat-exchanger disk 11, the entrainment plates 19 together with the spring packets 17 are held at the toothed rim 14 by an assembly tool or device which engages with extensions into the bores 31, and are pulled against the force of the spring packets 17 so far against the inner side 21 thereof until the heat-exchanger disk 11 can be inserted into the toothed rim 14. Thereupon, one loosens the device such that the entrainment plates 19 move gradually radially inwardly under the pressure of the spring packets 17 until they abut under prestress at the circumference 20 of the heat-exchanger disk 11. Thereupon, the device can be removed.

If the heat-exchanger is warmed-up during the operation of the gas turbine, then the metallic toothed rim 14 expands more strongly as a result of its larger coefficient of thermal expansion than the ceramic heat-exchanger disk 11. The radial length differences connected therewith between the two structural parts are compensated for by the spring packets 17. As a result of a spring characteristic of the cup springs 18 which is degressive in the installed condition, the abutment pressure thereof both during an increase as also during a decrease of the radial distance between the heat-exchanger disk 11 and the toothed rim 14 is not changed or only insignificantly changed so that a slipless torque transmission from the entrainment plates 19 connected with the toothed rim 14 to the heat-exchanger disk 11 is preserved under all operating conditions.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A regenerative heat-exchanger of a gas turbine, comprising a ceramic heat-exchanger disk, a metallic toothed rim substantially coaxially surrounding the heat-exchanger disk while forming an annular space, spring means arranged within the annular space which are supported under prestress, on the one hand, at entrainment plate means abutting at the circumference of the heat-exchanger disk and, on the other, against the inside of the toothed rim, characterized in that the spring means are formed by spring packets of cup springs which are guided on both sides in concave recess means provided in two webs arranged in the circumferential direction on the entrainment plate means, said webs surrounding the lateral surfaces of the toothed rim and being non-rotatably connected therewith.

2. A regenerative heat-exchanger according to claim 1, characterized in that mutually oppositely disposed radial bar means are provided at the insides of the two webs of an entrainment plate means which engage in radial grooves provided at the lateral surfaces of the toothed rim.

3. A regenerative heat-exchanger according to claim 2, characterized in that two spring packets are supported on a respective entrainment plate means and that the bar means of the webs are arranged in the center axial plane between the two spring packets.

4. A regenerative heat-exchanger according to claim 3, characterized in that one bore each is provided within the area of the two ends of each web for the application of an assembly device.

5. A regenerative heat-exchanger according to claim 1, characterized in that two spring packets are supported on a respective entrainment plate means and that the bar means of the webs are arranged in the center axial plane between the two spring packets.

6. A regenerative heat-exchanger according to claim 1, characterized in that one bore each is provided within the area of the two ends of each web for the application of an assembly device.

7. A regenerative heat-exchanger according to claim 6, characterized in that two spring packets are supported on a respective entrainment plate means and that the bar means of the webs are arranged in the center axial plane between the two spring packets.

* * * * *